US009843120B2

(12) United States Patent
Matsushita et al.

(10) Patent No.: US 9,843,120 B2
(45) Date of Patent: Dec. 12, 2017

(54) TERMINAL METAL FITTING

(71) Applicant: Yazaki Corporation, Tokyo (JP)

(72) Inventors: Kouichirou Matsushita, Shizuoka (JP); Naoki Takamura, Shizuoka (JP); Toshiaki Okabe, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/221,377

(22) Filed: Jul. 27, 2016

(65) Prior Publication Data

US 2017/0033488 A1 Feb. 2, 2017

(30) Foreign Application Priority Data

Jul. 31, 2015 (JP) ..... 2015-152411

(51) Int. Cl.
*H01R 43/16* (2006.01)
*H01R 13/11* (2006.01)
*H01R 4/18* (2006.01)

(52) U.S. Cl.
CPC ..... *H01R 13/113* (2013.01); *H01R 13/11* (2013.01); *H01R 4/185* (2013.01); *H01R 43/16* (2013.01)

(58) Field of Classification Search
CPC ..... H01R 13/113; H01R 13/11; H01R 4/184–4/188; H01R 43/16
USPC ..... 439/842–856, 889
See application file for complete search history.

(56) References Cited

U.S. PATENT DOCUMENTS 5,486,653 A 1/1996 Dohi
6,623,313 B1 9/2003 Ichida et al.
7,275,969 B2 * 10/2007 Fukaya ..... H01R 13/113 439/851
7,311,561 B2 * 12/2007 Anbo ..... H01R 4/185 439/752.5
7,419,409 B2 * 9/2008 Machida ..... H01R 13/4367 439/852

(Continued)

FOREIGN PATENT DOCUMENTS

JP 6-80263 U 11/1994
JP 7-326415 A 12/1995

(Continued)

OTHER PUBLICATIONS

Japanese Office Action for the related Japanese Patent Application No. 2015-152411 dated Jun. 27, 2017.

*Primary Examiner* — Amy Cohen Johnson
*Assistant Examiner* — Milagros Jeancharles
(74) *Attorney, Agent, or Firm* — Kenealy Vaidya LLP

(57) ABSTRACT

A terminal connecting body of a terminal metal fitting includes: a first engaging part and a second engaging part on one end side and another end side, respectively, that engage each other movements of an end of the one end side and an end of the other end side in separating directions; has a first gap formed between the first engaging part and the end of the other end side, that allows the end and the other end in directions opposite to the separating directions; and has a second gap formed therein, between the second engaging part and the end of the one end side, that enables the end and the other end in similar opposite directions. The first gap and the second gap are formed so that the first engaging part can be inserted into a notch provided on the other end side while being bent from its base.

4 Claims, 7 Drawing Sheets

(56) References Cited

U.S. PATENT DOCUMENTS 8,226,436 B2 * 7/2012 Suzuki ..... H01R 13/113
439/595
8,241,077 B2 * 8/2012 Suzuki ..... H01R 13/114
439/852
8,419,471 B2 * 4/2013 Suzuki ..... H01R 13/4223
439/595
8,764,482 B2 * 7/2014 Matsumura ..... H01R 13/113
439/595
9,391,384 B2 * 7/2016 Kodama ..... H01R 4/62
2003/0049965 A1 3/2003 Fujita et al.
2003/0049975 A1 * 3/2003 Tsuji ..... H01R 43/16
439/843
2003/0228795 A1 12/2003 Ichida et al.
2003/0228797 A1 12/2003 Ichikawa et al.
2003/0228798 A1 12/2003 Nankou et al.
2004/0180576 A1 * 9/2004 Hasebe ..... H01R 13/113
439/595
2004/0253881 A1 * 12/2004 Sakurai ..... H01R 4/185
439/752
2005/0032424 A1 2/2005 Ichida et al.
2005/0191912 A1 * 9/2005 Maeda ..... H01R 43/16
439/843
2011/0212654 A1 * 9/2011 Suzuki ..... H01R 13/113
439/733.1
2011/0212656 A1 9/2011 Suzuki et al.
2013/0126236 A1 * 5/2013 Suzuki ..... H01R 4/185
174/84 C

FOREIGN PATENT DOCUMENTS

JP 2003-86281 A 3/2003
JP 2004-31034 A 1/2004
JP 2005-5109 A 1/2005
JP 2011-181330 A 9/2011
JP 2013-232333 A 11/2013
JP 2014-182981 A 9/2014

* cited by examiner

TERMINAL METAL FITTING

CROSS-REFERENCE TO RELATED APPLICATION(S)

The present application claims priority to and incorporates by reference the entire contents of Japanese Patent Application No. 2015-152411 filed in Japan on Jul. 31, 2015.

BACKGROUND OF THE INVENTION

1. Field of the Invention

The present invention relates to a terminal metal fitting.

2. Description of the Related Art

Conventionally, terminal metal fittings formed into a predetermined shape by punching a metal plate, prepared as a base material, into a predetermined developed shape and performing a bending process and the like on the plate have been known. For example, in such a terminal metal fitting, a box shape is formed when a plurality of portions of a certain part in its developed shape are bent in the same direction. The box body is then used as a terminal connecting body that is electrically connected to a counterpart terminal (refer to, for example, Japanese Patent Application Laid-open No. 2004-31034, Japanese Patent Application Laid-open No. 2005-5109, and Japanese Patent Application Laid-open No. 2003-86281).

Springback occurs in such a terminal connecting body that is obtained by performing the bending process. The springback is a tendency to return to the developed shape. For this reason, for example, in the terminal metal fittings disclosed in Japanese Patent Application Laid-open No. 2004-31034, Japanese Patent Application Laid-open No. 2005-5109, and Japanese Patent Application Laid-open No. 2003-86281, a piece part (a regulated projection unit or a holding piece) is provided on one end side of the terminal connecting body, and a groove (a regulating groove or a holding groove) into which the piece part is fitted is formed on the other end side of the terminal connecting body. In this manner, the terminal connecting body is prevented from deforming outwardly because of the springback. In a coating crimping part of the terminal metal fitting, the thickness of the barrel piece is made thinner than the thickness of the bottom part, or the thickness of the bottom part is made thinner than the thickness of the barrel piece. This is done to reduce the orthogonal sectional shape (shape of a section orthogonal to the axis line direction of an electric wire) after the electric wire is crimped to the coating portion (such as Japanese Utility Model Application Laid-open No. 6-80263 and Japanese Patent Application Laid-open No. 2013-232333).

The conventional terminal metal fitting adopts a structure in which the piece part is fitted into the groove, so as to prevent the terminal connecting body from deforming outwardly because of the springback. However, because the terminal metal fitting adopts the fitting structure, a gap between the piece part and the groove is very small. Thus, it is difficult to correctly fit the piece part into the groove, during the bending process of the terminal connecting body.

SUMMARY OF THE INVENTION

An object of the present invention is to provide a terminal metal fitting that can be produced with excellent productivity and in which a terminal connecting body has an outward deformation preventing structure.

In order to achieve the above mentioned object, a terminal metal fitting according to one aspect of the present invention includes an electric wire connecting body to which an end of an electric wire is electrically connected; and a terminal connecting body that has an axis line direction set to a connecting direction of the terminal connecting body with a counterpart terminal to be electrically connected to the terminal connecting body, and that is formed into a box shape with a terminal side plate body made of metal being bent at a plurality of portions between one end side and another end side around an axis line, wherein the terminal connecting body includes a first engaging part and a second engaging part on the one end side and the other end side, respectively, that engage each other movements of an end of the one end side and an end of the other end side in separating directions, the movements being due to springback in response to the bending, the terminal connecting body has a first gap, formed between the first engaging part and the end of the other end side, that enables the end of the one end side and the end of the other end side to move each other in directions opposite to the separating directions, and has a second gap, formed between the second engaging part and the end of the one end side, that enables the end of the one end side and the end of the other end side to move each other in directions opposite to the separating directions, the first engaging part is a piece part that is bent at the end of the one end side as a base along a direction of the bending, and projected from the end of the one end side toward the end of the other end side, the second engaging part includes an end surface of a notch that is provided on the other end side as an engagement surface or an engagement point with the first engaging part, and the first gap and the second gap are formed so that the first engaging part is insertable into the notch while being bent at the base.

According to another aspect of the present invention, in the terminal metal fitting, it is desirable that the first engaging part and the second engaging part are disposed at one end of the terminal connecting body in the axis line direction, and the second gap is desirably formed also between the end of the one end side and the end of the other end side and is extended toward the other end side in the axis line direction.

According to still another aspect of the present invention, in the terminal metal fitting, it is desirable that the first gap and the second gap are formed so that when the second gap becomes small, and the second engaging part abuts the end of the one end side or the end of the one end side abuts the end of the other end side, a size of the first gap remains so that the first engaging part is bendable from the base and the first engaging part is insertable into the notch.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a terminal metal fitting according to the present invention will be described in detail with reference to the accompanying drawings. It is to be noted that the present invention is not limited to the embodiment.

Embodiment

An embodiment of the terminal metal fitting according to the present invention will now be described with reference to FIG. 1 to FIG. 9.

Figure 1:
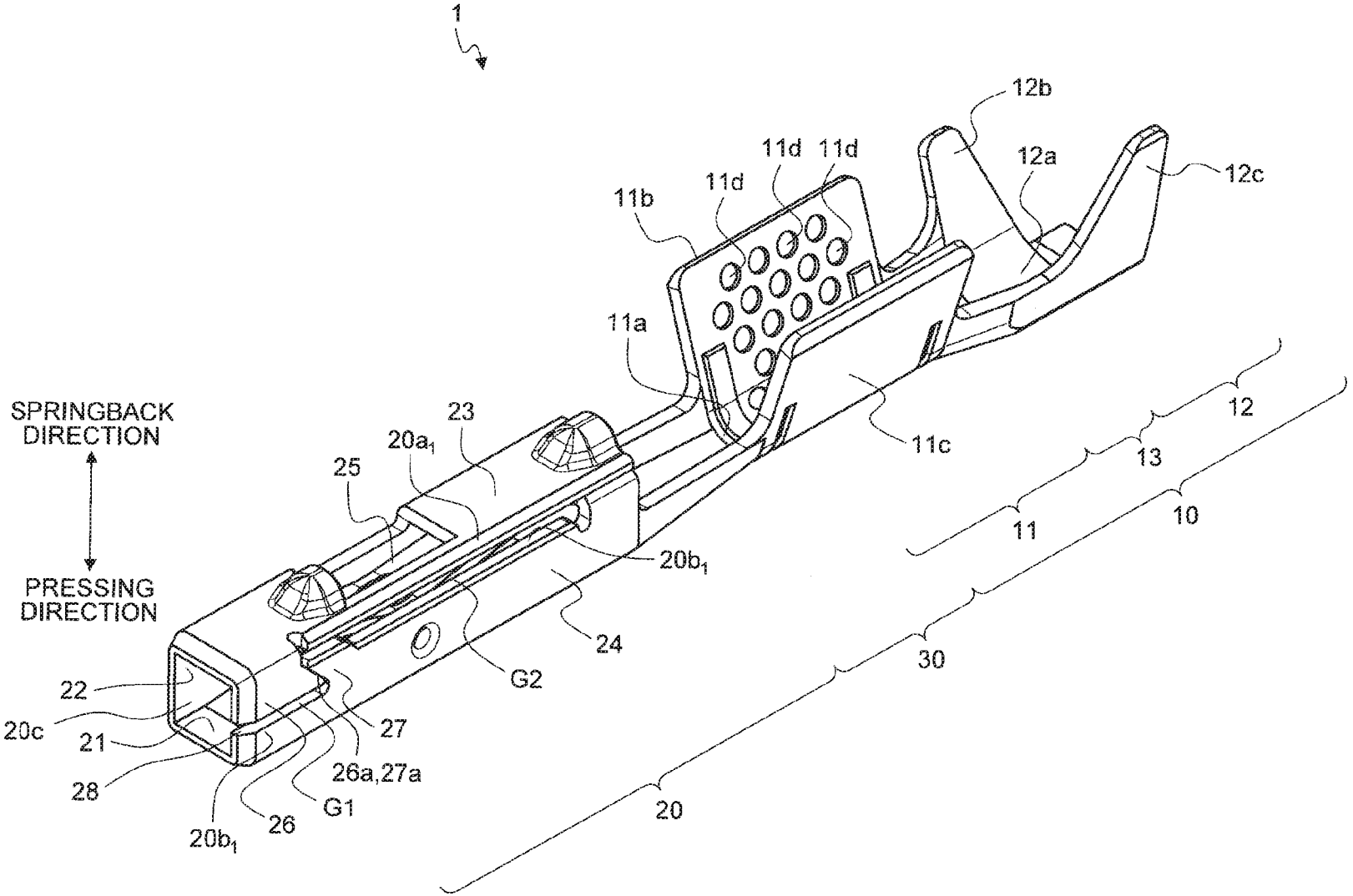
FIG. 1 is a perspective view illustrating a terminal metal fitting of an embodiment.
Figure 2:
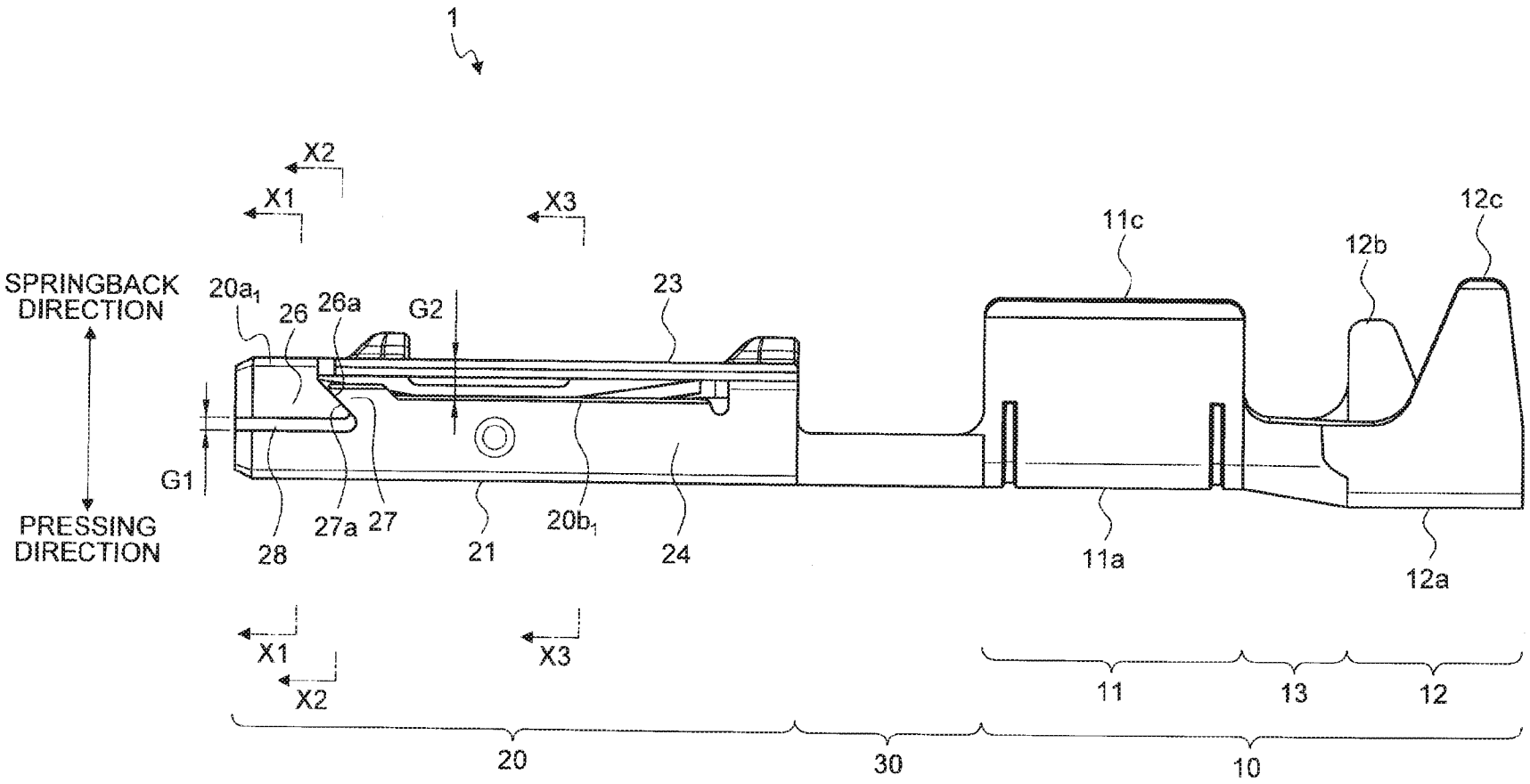
FIG. 2 is a side view illustrating the terminal metal fitting of the embodiment.
Figure 3:
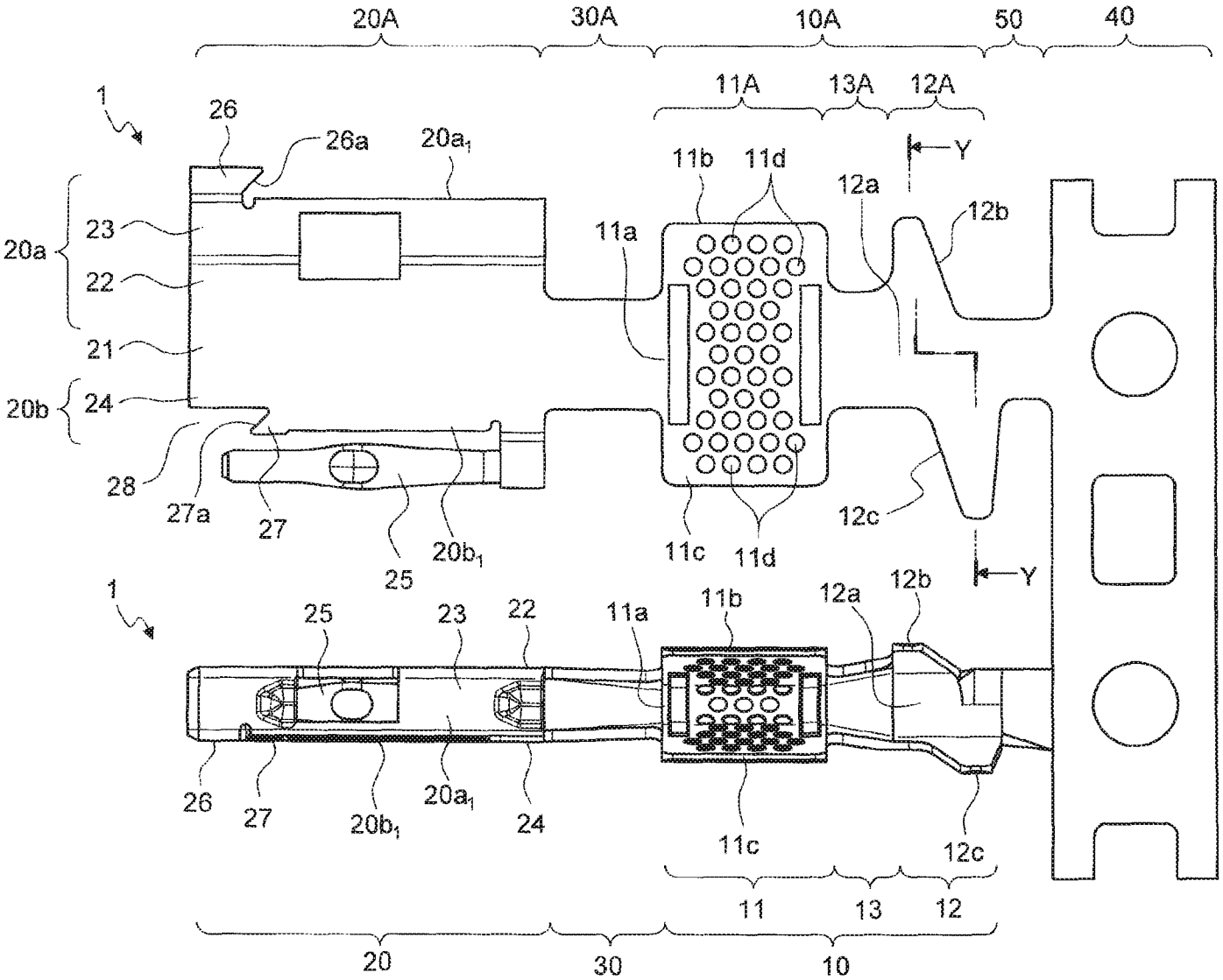
FIG. 3 is a top view illustrating a terminal chain body including the terminal metal fitting in its developed shape and the terminal metal fitting in its formed shape.
Figure 4:
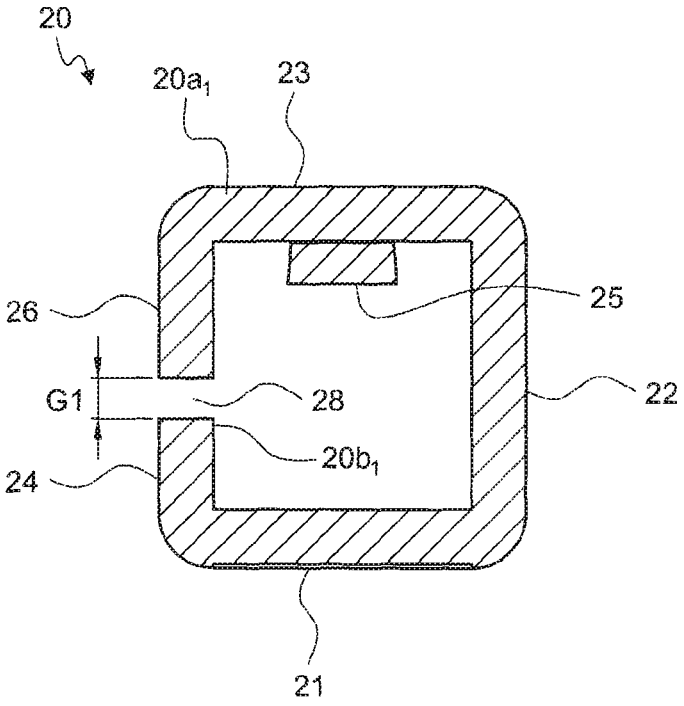
FIG. 4 is a sectional view of a terminal connecting body cut along line X1-X1 in FIG. 2.
Figure 5:
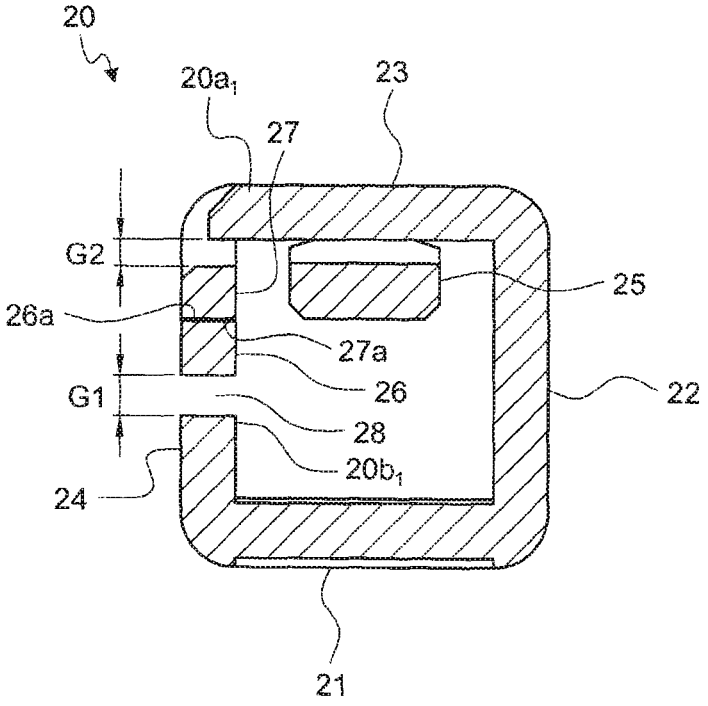
FIG. 5 is a sectional view of the terminal connecting body cut along line X2-X2 in FIG. 2.
Figure 6:
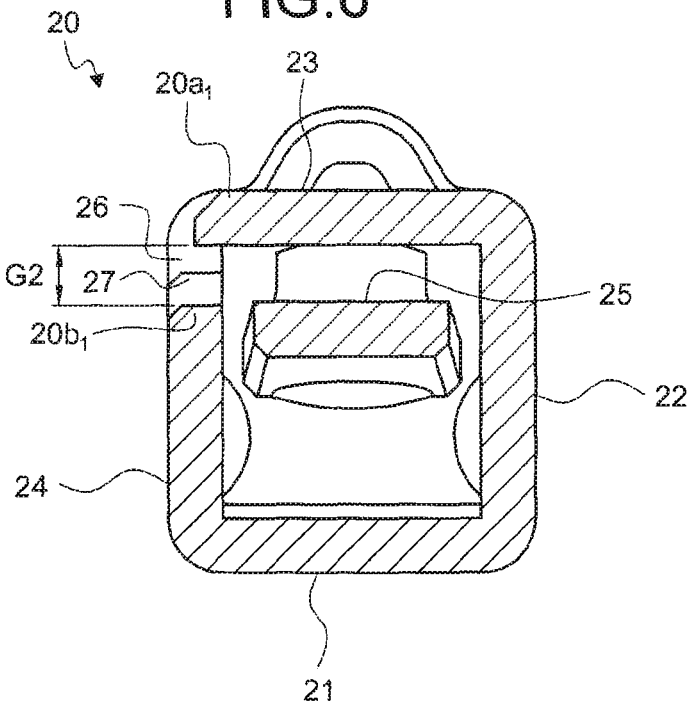
FIG. 6 is a sectional view of the terminal connecting body cut along line X3-X3 in FIG. 2.

Reference numeral 1 from FIG. 1 to FIG. 3 denotes a terminal metal fitting of the present embodiment. The terminal metal fitting 1 is electrically connected to an electric wire 100 (FIG. 9), and is electrically connected to a counterpart terminal (not illustrated) while being integrated with the electric wire 100. In this example, to expose a predetermined length of a core wire 101, the predetermined length of coating 102 of an end of the electric wire 100 is peeled off and removed. The core wire 101 may be an assembly of a plurality of strands or a single line such as a coaxial cable. To be electrically connected to the electric wire 100, the terminal metal fitting 1 is crimped to the end of the electric wire 100. Thus, the terminal metal fitting 1 is electrically connected to the exposed end of the core wire 101.

The terminal metal fitting 1 is obtained by punching a metal plate (such as a copper plate) that is a base material into its predetermined developed shape (the upper portion in FIG. 3), and performing a bending process and the like on the plate, so as to form the metal plate into a predetermined shape capable of being connected to the counterpart terminal and the electric wire 100 (the lower portion in FIG. 3). The terminal metal fitting 1 includes an electric wire connecting body 10 to which an end of the electric wire 100 is electrically connected, and a terminal connecting body 20 that is electrically connected to a counterpart terminal. The electric wire connecting body 10 and the terminal connecting body 20 are coupled by a coupling body 30 interposed therebetween.

The terminal metal fitting 1 in its developed shape includes an electric wire side plate body 10A having a plate shape that is formed into the electric wire connecting body 10, a terminal side plate body 20A having a plate shape that is formed into the terminal connecting body 20, and a coupling body 30A having a plate shape that is formed into the coupling body 30. A plurality of terminal metal fittings 1 in their developed shapes that are arranged on the base material are punched out as a chain body (hereinafter, referred to as a "terminal chain body"). The terminal chain body is an assembly of the terminal metal fittings 1 that are arranged in parallel at equal intervals while facing the same direction, and that are joined in a chained state. In the terminal chain body, one end of each of all the terminal metal fittings 1 is joined by a coupling piece 40. For example, the coupling piece 40 is formed into a rectangular plate shape, and is disposed relative to the electric wire connecting body 10 (electric wire side plate body 10A) of each of all the terminal metal fittings 1 with a predetermined interval therebetween. For example, a bottom part 12*a*, which will be described below, of the electric wire connecting body 10 (electric wire side plate body 10A) and the coupling piece 40 are joined by a joining part 50 having a rectangular plate shape, for each of the terminal metal fittings 1. The bending process or the like is performed on each of the terminal metal fittings 1 in their developed shapes, of the terminal chain body.

In the terminal metal fitting 1, the longitudinal direction is defined as a connecting direction (inserting direction) with the counterpart terminal. Thus, it is assumed that the terminal metal fitting 1 has an axis line along the connecting direction. Consequently, a direction that is simply referred to as the axis line direction in the following indicates the direction of the axis line along the connecting direction. In the terminal metal fitting 1, the electric wire 100 is placed on the terminal metal fitting 1 when the terminal metal fitting 1 is crimped to the electric wire 100. The vertical direction is defined by setting, as a base, a portion in one side where the electric wire 100 is placed.

The electric wire connecting body 10 is a portion obtained by performing the bending process on the electric wire side plate body 10A, and is formed in a U-shape before the electric wire 100 is connected. The electric wire connecting body 10 includes a core wire crimping part 11 that is crimped to the end of the core wire 101, a coating crimping part 12 that is crimped to the coating 102 at the end of the electric wire 100, and a coupling part 13 that couples the core wire crimping part 11 and the coating crimping part 12.

The core wire crimping part 11 includes a bottom part 11*a* onto which the core wire 101 is placed when crimping is performed, and two barrel pieces 11*b* and 11*c* that are extended from both ends (both ends in the direction orthogonal to the axis line direction) of the bottom part 11*a* in the oblique upward direction, respectively. A core wire crimping part 11A that has a rectangular shape and includes the bottom part 11*a*, and the barrel pieces 11*b* and 11*c* are provided in the electric wire side plate body 10A. A serration area is formed on the entire placing surface of the core wire 101. The serration area is a core wire holding area to hold the core wire 101 being crimped. The adhesion strength between the core wire crimping part 11 and the core wire 101 is increased, by increasing the contact area between the core wire crimping part 11 and the core wire 101 by the presence of irregularities. In this example, the serration area is formed with a plurality of recess portions 11*d* arranged in a rectangular shape.

The coating crimping part 12 includes the bottom part 12*a* onto which the coating 102 is placed when crimping is performed, and two barrel pieces 12*b* and 12*c* that are extended in obliquely upward directions from both ends (both ends in the direction orthogonal to the axis line direction) of the bottom part 12*a*, respectively. The bottom part 12*a* is joined to the bottom part 11*a* of the core wire crimping part 11 by the coupling part 13 (coupling part 13A of the electric wire side plate body 10A). The barrel pieces 12*b* and 12*c* are arranged out of alignment with each other in the axis line direction so that the barrel pieces 12*b* and 12*c* are not overlapped with each other when the barrel pieces

Figure 8:
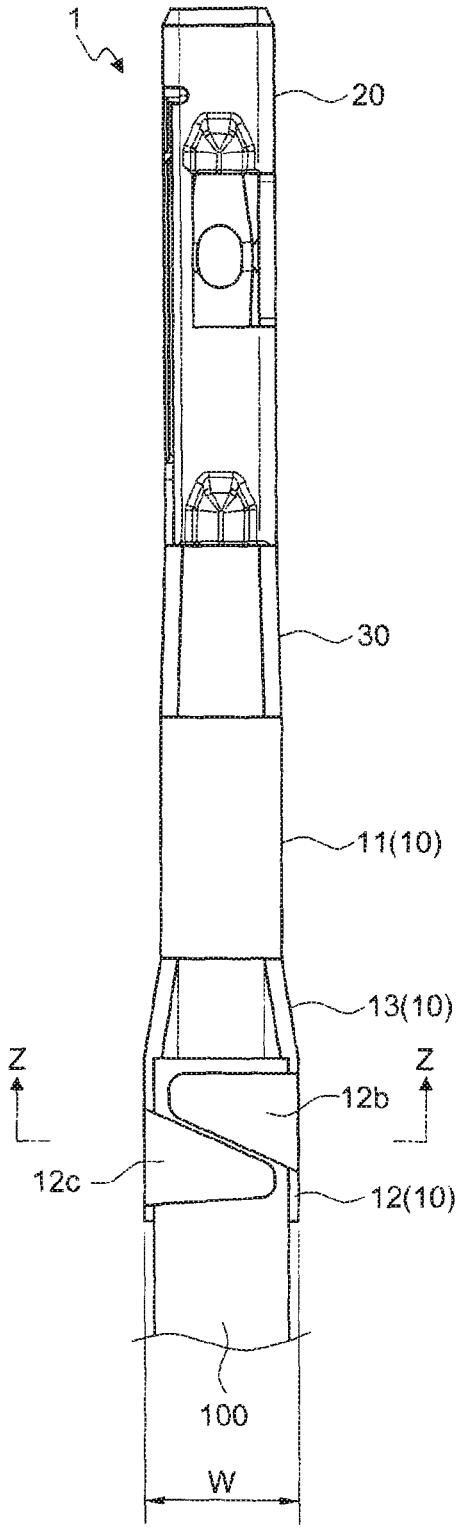
FIG. 8 is a top view illustrating the terminal metal fitting to which an electric wire is crimped.
Figure 9:
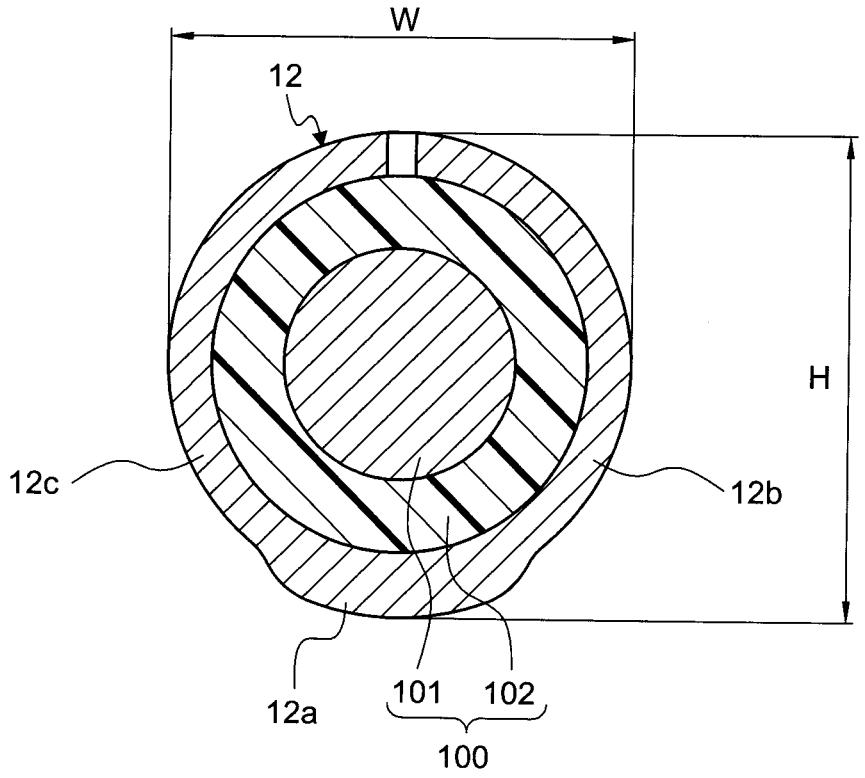
FIG. 9 is a conceptual sectional view of the coating crimping part and the electric wire cut along line Z-Z in FIG. 8.

12*b* and 12*c* are crimped to the coating 102 (FIG. 8). The electric wire side plate body 10A includes a coating crimping part 12A that has the bottom part 12*a* and the barrel pieces 12*b* and 12*c*.

The terminal connecting body 20 is formed into a box shape by bending, around the axis line, a plurality of portions between one end side 20*a* (FIG. 3) and another end side 20*b* (FIG. 3) of the terminal side plate body 20A made of metal that is in the developed shape. The terminal connecting body 20 (terminal side plate body 20A) includes a lower wall 21 having a rectangular shape that is coupled to the bottom part 11*a* of the core wire crimping part 11 (core wire crimping part 11A) by the coupling body 30 (coupling body 30A). The one end side 20*a* and the other end side 20*b* are one side and the other side (one side and the other side in the direction orthogonal to the axis line direction) relative to the lower wall 21.

The one end side 20*a* of the terminal connecting body 20 (terminal side plate body 20A) includes a side wall 22 and an upper wall 23. The side wall 22 is a wall that is adjoined to an end of one side of the lower wall 21, and is bent at about 90 degrees relative to the lower wall 21. The upper wall 23 is a wall that is adjoined to an end of the side wall 22 in the opposite side of the lower wall 21 side of the side wall 22, and is bent at about 90 degrees relative to the side wall 22. The upper wall 23 faces the lower wall 21 after the bending process. In the one end side 20*a* in the developed shape, a free end side of the upper wall 23 in the orthogonal direction described above is an end $\mathbf{20}a_1$.

The terminal connecting body 20 (terminal side plate body 20A) also has another side wall 24 in the other end side 20*b*. The side wall 24 is a wall that is adjoined to an end of the lower wall 21 in the other side of the lower wall 21, and is bent at about 90 degrees relative to the lower wall 21. In the other end side 20*b* in the developed shape, a free end side of the side wall 24 in the orthogonal direction described above is an end $\mathbf{20}b_1$.

When being bent and processed into the terminal connecting body 20 having a box shape, the terminal side plate body 20A is formed so that the end $\mathbf{20}a_1$ of the one end side 20*a* and the end $\mathbf{20}b_1$ of the other end side 20*b* are disposed close to each other.

The terminal side plate body 20A includes a spring part 25 arranged apart from and side by side with the end $\mathbf{20}b_1$. The spring part 25 is a substantially rectangular portion extended in the axis line direction, and is coupled to a part of the end $\mathbf{20}b_1$ (coupling body 30A side). The spring part 25 is bent toward the terminal connecting body 20, bent toward the same direction at a bend line in the end $\mathbf{20}b_1$ side, as well as being bent into an L-shape in the middle thereof in its extended direction, so as to be disposed inside the terminal connecting body 20 having a box shape. The L-shaped portion of the spring part 25 holds the counterpart terminal with the lower wall 21.

A press forming machine (not illustrated) applies a force (pressing force) to the upper wall 23 in a pressing direction toward the lower wall 21, while the bending process is performed on all corresponding portions of the terminal side plate body 20A. The pressing force is a force against the springback that occurs in response to the bending to form a box shape. Thus, in the terminal connecting body 20, when the pressing force is removed, there is a possibility that the terminal connecting body 20 may be deformed outwardly in the direction to return to the developed shape, by the springback. The outward deformation separates the end $\mathbf{20}a_1$ of the one end side 20*a* and the end $\mathbf{20}b_1$ of the other end side 20*b* from each other and prevents the terminal connecting body 20 from maintaining the predetermined box shape.

The terminal connecting body 20 of the present embodiment (terminal side plate body 20A) is provided with an outward deformation preventing structure for preventing the terminal connecting body 20 from deforming outwardly. In the outward deformation preventing structure, the end $\mathbf{20}a_1$ of the one end side 20*a* and the end $\mathbf{20}b_1$ of the other end side 20*b* are engaged with each other, and the movements thereof in directions separating from each other, which occur because of the springback, are stopped. More specifically, for the engagement, a first engaging part 26 and a second engaging part 27 are provided in the one end side 20*a* and the other end side 20*b*, respectively. The first engaging part 26 and the second engaging part 27 of the present embodiment are disposed on one end (side of an opening 20*c* into which the counterpart terminal is inserted (FIG. 1)) of the terminal connecting body 20 (terminal side plate body 20A) in the axis line direction.

The first engaging part 26 is a piece part that is bent with the end $\mathbf{20}a_1$ of the one end side 20*a* used as a folding line, along the bending direction toward the box shape, and that is projected from the end $\mathbf{20}a_1$ of the one end side 20*a* toward the end $\mathbf{20}b_1$ of the other end side 20*b*. Thus, the wall surface of the first engaging part 26 is arranged along the springback direction. The first engaging part 26 includes an inclined end surface 26*a* that is directed toward the other end side (coupling body 30 side) in the axis line direction, as the first engaging part 26 separates from the end $\mathbf{20}a_1$ in the projecting direction. The inclined end surface 26*a* is an end surface of the first engaging part 26 at the other end side in the axis line direction. Because of the inclination, the inclined end surface 26*a* is facing the outward deformation direction in the springback. In the first engaging part 26, the inclined end surface 26*a* is used as an engagement surface with the second engaging part 27, or a part of the inclined end surface 26*a* is used as an engagement point with the second engaging part 27. The end surface of the first engaging part 26 at the one end side in the axis line direction forms a part of the opening 20*c* of the terminal connecting body 20.

The first engaging part 26 is inserted into a notch 28 that is provided in the other end side 20*b* (in this example, the side wall 24). The notch 28 is a portion being notched from one end toward another end in the axis line direction, at one end of the end $\mathbf{20}b_1$ side of the side wall 24 in the axis line direction. The notch 28 has a shape equivalent to that of the first engaging part 26. In the side wall 24, a portion facing the end $\mathbf{20}a_1$ of the one end side 20*a* in the notch 28 is also the end $\mathbf{20}b_1$ of the other end side 20*b*.

The second engaging part 27 is provided on the other end side 20*b* (in this example, the side wall 24). The second engaging part 27 has an inclined end surface 27*a* that is directed toward the other end side (coupling body 30 side) in the axis line direction while approaching the lower wall 21 from the end $\mathbf{20}b_1$. The inclined end surface 27*a* faces the inclined end surface 26*a* of the first engaging part 26 when the terminal connecting body 20 is formed into a box shape. In the second engaging part 27, the inclined end surface 27*a* is used as an engagement surface with the inclined end surface 26*a* of the first engaging part 26, or a part of the inclined end surface 27*a* is used as an engagement point with the inclined end surface 26*a* of the first engaging part 26. In this example, the inclined end surface 27*a* is also an end surface of the other end side of the notch 28 in the axis line direction. Thus, the second engaging part 27 uses the end surface of the notch 28 as an engagement surface or an engagement point with the first engaging part 26. The wall surface of the second engaging part 27 of the present embodiment is a piece part that is arranged along the springback direction, and a part of the second engaging part 27 is projected more in the upper direction (in other words, toward the end $\mathbf{20}a_1$ side) than the end $\mathbf{20}b_1$.

When the first engaging part 26 and the notch 28 have a fitting structure, to perform the bending process on the terminal side plate body 20A, the first engaging part 26 needs to be fitted into the notch 28 while being bent. In other words, even if a gap is provided between the first engaging part 26 and the notch 28, the gap is very small. Thus, when the fitting structure is employed, the processing accuracy for the shapes and the sizes of the first engaging part 26 and the notch 28 needs to be enhanced to fit the first engaging part 26 into the notch 28 without fail. However, even if the first engaging part 26 and the notch 28 are formed at great cost in this manner, if a deviation occurs at the bent portion in each part, even if the deviation falls within a tolerance range, there is a possibility that accumulation of the deviations may prevent the first engaging part 26 from being fit into the notch 28.

In the terminal connecting body 20 of the present embodiment, a first gap G1 (FIG. 1, FIG. 2, FIG. 4, and FIG. 5) is formed between the first engaging part 26 and the end $\mathbf{20}b_1$ of the other end side 20*b*, and a second gap G2 (FIG. 1, FIG. 2, FIG. 5, and FIG. 6) is formed between the second engaging part 27 and the end $\mathbf{20}a_1$ of the one end side 20*a*. The first gap G1 and the second gap G2 each has a size that can move the end $\mathbf{20}a_1$ of the one end side 20*a* and the end $\mathbf{20}b_1$ of the other end side 20*b* in directions opposite from the respective separating directions due to the springback. In other words, the sizes of the first gap G1 and the second gap G2 allow the end $\mathbf{20}a_1$ of the one end side 20*a* and the end $\mathbf{20}b_1$ of the other end side 20*b* to move (in other words, the end $\mathbf{20}a_1$ and the end $\mathbf{20}b_1$ to be brought close to each other) in the directions opposite from the separating directions due to the springback. This is made possible by bringing the first engaging part 26 and the end $\mathbf{20}b_1$ of the other end side 20*b* into a releasing direction of the engagement between the first engaging part 26 and the second engaging part 27 and bringing the second engaging part 27 and the end $\mathbf{20}a_1$ of the one end side 20*a* into a releasing direction of the engagement between the first engaging part 26 and the second engaging part 27 when force is applied in a direction that causes the lower wall 21 and the upper wall 23 to approach each other.

In this example, the first gap G1 and the second gap G2 are formed into sizes that are set so that the first engaging part 26 can be inserted into the notch 28 while being bent with its base used as a folding line, during each bending process. For example, to obtain the first gap G1 such as the above, the size of the notch 28 is made larger than that of the first engaging part 26 even if the notch 28 has the same shape as that of the first engaging part 26. To obtain the second gap G2 such as the above, the projection amount of the second engaging part 27 described above toward the end $\mathbf{20}a_1$ side is made smaller. In this example, the second engaging part 27 is projected more toward the end $\mathbf{20}a_1$ side than the end $\mathbf{20}b_1$. Thus, the second gap G2 is also formed between the end $\mathbf{20}a_1$ and the end $\mathbf{20}b_1$. Consequently, the first gap G1 and the second gap G2 allow the end $\mathbf{20}a_1$ and the end $\mathbf{20}b_1$ to be easily brought close to each other. If the second engaging part 27 is not projected more toward the end $\mathbf{20}a_1$ side than the end $\mathbf{20}b_1$, it is preferable to form the second gap G2 between the end $\mathbf{20}a_1$ and the end $\mathbf{20}b_1$, and extend the second gap G2 toward the other end side in the axis line direction, so that it is possible to easily bring the end $\mathbf{20}a_1$ and the end $\mathbf{20}b_1$ close to each other.

For example, during the bending process, the pressing force described above is applied to the upper wall 23 by the press forming machine. Consequently, it is possible to bring the end $\mathbf{20}a_1$ and the end $\mathbf{20}b_1$ close to each other, with the first gap G1 and the second gap G2, by pressing the upper wall 23 inward toward the lower wall 21 using the pressing force. Thus, for example, the first gap G1 and the second gap G2 are formed so that when the second gap G2 becomes small, and the second engaging part 27 abuts the end $\mathbf{20}a_1$ of the one end side 20*a* or the end $\mathbf{20}a_1$ of the one end side 20*a* abuts the end $\mathbf{20}b_1$ of the other end side 20*b*, the first gap G1 that is interposed between the first engaging part 26 and the end $\mathbf{20}b_1$ of the other end side 20*b* remains. The interposed first gap G1 has a size such that the first engaging part 26 can be bent from its base, and the first engaging part 26 can be inserted into the notch 28. Consequently, by keep bending the first engaging part 26 from its base in that state by the press forming machine, it is possible to easily insert the first engaging part 26 into the notch 28.

The press forming machine finishes the forming process on the terminal connecting body 20 by weakening the pressing force and finally reducing the pressing force to zero. During this time, in the terminal connecting body 20, the end $\mathbf{20}a_1$ of the one end side 20*a* separates from the end $\mathbf{20}b_1$ of the other end side 20*b* when the lower wall 21 separates from the upper wall 23 because of the springback. Consequently, the inclined end surface 26*a* of the first engaging part 26 and the inclined end surface 27*a* of the second engaging part 27 abut each other and are engaged with each other. In this manner, it is possible to prevent the terminal connecting body 20 from deforming outwardly because of the springback.

As illustrated above, in the terminal metal fitting 1 of the present embodiment, it is possible to easily insert the first engaging part 26 into the notch 28 and engage the first engaging part 26 with the second engaging part 27 without enhancing the processing accuracy of the first engaging part 26 and the notch 28. Consequently, the terminal metal fitting 1 can prevent the terminal connecting body 20 from deforming outwardly because of the springback, while maintaining its capability of being produced with good productivity.

Figure 7:
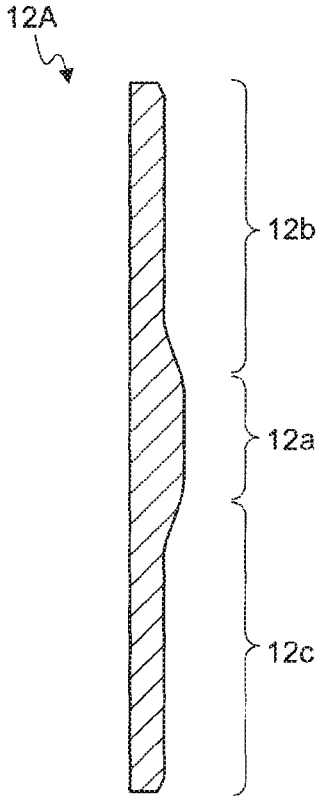
FIG. 7 is a sectional view of a coating crimping part in the developed shape, cut along line Y-Y in FIG. 3.

In the coating crimping part 12A in the developed shape of the terminal metal fitting 1 of the present embodiment, it is preferable to reduce the thicknesses of the two barrel pieces 12*b* and 12*c* relative to that of the bottom part 12*a* (FIG. 7). In the coating crimping part 12A, one surface side, on which the coating 102 is placed, that becomes the inside has the same plane, and the thicknesses of the barrel pieces 12*b* and 12*c* are reduced in the outer sides thereof. In this manner, for example, in the coating crimping part 12 that is crimped to the coating 102, it is possible to reduce the width W (FIG. 8 and FIG. 9) in the orthogonal direction described above, and reduce the height H (FIG. 9) in the vertical direction, by the barrel pieces 12*b* and 12*c* having thin thicknesses. Consequently, it is possible to reduce the body size.

The terminal metal fitting according to the present embodiment can easily insert the first engaging part into the notch and engage the first engaging part with the second engaging part, without enhancing the processing accuracy for the first engaging part and the notch. Thus, the terminal metal fitting can prevent the terminal connecting body from deforming outwardly because of the springback, while maintaining its capability of being produced with good productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal metal fitting comprising:

an electric wire connecting body to which an end of an electric wire is electrically connected; and a terminal connecting body that has an axis line direction set to a connecting direction of the terminal connecting body with a counterpart terminal to be electrically connected to the terminal connecting body, and that is formed into a box shape with a terminal side plate body made of metal being bent at a plurality of portions between one end side and another end side around an axis line, wherein the terminal connecting body includes a first engaging part and a second engaging part on the one end side and the other end side, respectively, that engage each other during movements of an end of the one end side and an end of the other end side in separating directions, the movements being due to springback in response to the bending, the terminal connecting body has a first gap, formed between the first engaging part and the end of the other end side, that enables the end of the one end side and the end of the other end side to move relative to each other in directions opposite to the separating directions, and has a second gap, formed between the second engaging part and the end of the one end side, that enables the end of the one end side and the end of the other end side to move relative to each other in directions opposite to the separating directions, the first engaging part is a piece part that is bent at the end of the one end side as a base along a direction of the bending, and projected from the end of the one end side toward the end of the other end side, the second engaging part includes an end surface of a notch that is provided on the other end side as an engagement surface or an engagement point with the first engaging part, the first gap and the second gap are formed so that the first engaging part is insertable into the notch while being bent at the base, the terminal connecting body includes an opening configured to receive the counterpart terminal in the connecting direction, and a side edge of the first engaging part along with a side edge of the terminal side plate body define the opening.

2. The terminal metal fitting according to claim 1, wherein the first engaging part and the second engaging part are disposed at one end of the terminal connecting body in the axis line direction, and the second gap is formed also between the end of the one end side and the end of the other end side and is extended toward the other end side in the axis line direction.

3. The terminal metal fitting according to claim 1, wherein the first gap and the second gap are formed so that when the second gap becomes small, and the second engaging part abuts the end of the one end side or the end of the one end side abuts the end of the other end side, a size of the first gap remains so that the first engaging part is bendable from the base and the first engaging part is insertable into the notch.

4. The terminal metal fitting according to claim 2, wherein the first gap and the second gap are formed so that when the second gap becomes small, and the second engaging part abuts the end of the one end side or the end of the one end side abuts the end of the other end side, a size of the first gap remains so that the first engaging part is bendable from the base and the first engaging part is insertable into the notch.

* * * * *